United States Patent [19]

Sakka

[11] Patent Number: 4,535,593

[45] Date of Patent: Aug. 20, 1985

[54] METHOD OF AND APPARATUS FOR WARMING HIGH-PRESSURE FEED WATER HEATERS FOR POWER PLANTS

[75] Inventor: Kenji Sakka, Hitachi, Japan

[73] Assignee: Hitachi, Ltd., Tokyo, Japan

[21] Appl. No.: 410,601

[22] Filed: Aug. 23, 1982

[30] Foreign Application Priority Data

Aug. 28, 1981 [JP] Japan ..... 56-133966

[51] Int. Cl.[3] ..... F01K 13/02

[52] U.S. Cl. ..... 60/646; 60/656

[58] Field of Search ..... 60/646, 656, 678, 689, 60/691; 122/406 ST, 412

[56] References Cited

U.S. PATENT DOCUMENTS

| | | | |
|---|---|---|---|
| 3,370,573 | 2/1968 | Hanzalek et al. | 122/406 ST |
| 3,590,787 | 7/1971 | Stevens | 122/406 ST |
| 3,954,087 | 5/1976 | Stevens et al. | 122/406 ST X |
| 4,287,430 | 9/1981 | Guido | 60/646 X |

*Primary Examiner*—Stephen F. Husar

*Attorney, Agent, or Firm*—Antonelli, Terry & Wands

[57] ABSTRACT

A method of and apparatus for warming high-pressure feed water heaters for power plants provided with a boiler having a circulation system, in which a part of high-temperature water flowing in the circulation system is separated therefrom to introduce the resulting feed water into a high-pressure feed water heater from the portion of a feed water system which is on the side of an inlet portion thereof, with the feed water flowing out from the heater returned to the boiler, during a period of time which is between an instant, at which the boiler is ignited, and an instant, at which the heater is put in service, the heater being thereby warmed, a flow rate of the feed water introduced from the boiler to the heater being controlled in accordance with the temperature of the feed water flowing down in the same heater, whereby the occurrence of an excessively high thermal stress in the heater can be prevented when the heater is put in service.

11 Claims, 3 Drawing Figures

METHOD OF AND APPARATUS FOR WARMING HIGH-PRESSURE FEED WATER HEATERS FOR POWER PLANTS

BACKGROUND OF THE INVENTION

This invention relates to a method and apparatus for warming high-pressure feed water heaters for use in starting thermal power plants.

The once-through boilers used for thermal power plants include Benson boilers and, in a certain kind of Benson boilers operated at a varying pressure, it is necessary to secure at the time of starting the boilers a predetermined circulation rate of feed water flowing therein. Accordingly, some of such boilers are provided with a so-called circulation system, wherein as shown in, for example, "Ishikawajima Harima Technical Report", Vol. 18, No. 2 (published in March 1978), FIG. 21, page 196, a part of the feed water is taken out from the portion of the boiler which is on the upstream side of a primary superheater, to be introduced into a liberating tank, the resulting feed water, from which vapor has been separated, being sent by a circulating pump to the portion of the boiler which is on the upstream side of a fuel economizer. In order to start a power plant provided with such a boiler, the boiler is ignited to circulate the feed water through a recirculation system therein. During such a period of time, that is, the time between an instant at which the boiler is ignited, and an instant at which the vapor starts being supplied to a steam turbine, the feed water in a deaerator provided in the portion of a feed water system which extends between a condenser and boiler is in a vacuum-deaerated state. According, the temperature of the feed water flowing through the first through third high-pressure feed water heaters, provided on the portion of the feed water system which extends between the deaerator and boiler, is increased to only about 60° C. However, it is necessary that the temperatures of the feed water in the high-pressure feed water heaters be increased to about 130°–190° C. by practically utilizing these heaters in order, by the time the steam turbine has come to have about 20% partial load (by the time about twenty minutes have elapsed) after the vapor has started being supplied thereto. Therefore, during such a short period of time of about twenty minutes after the starting of supplying vapor to the steam turbine, the heated vapor is extracted from the turbine to be introduced into the feed water heaters, and the temperature of the feed water is thus increased suddenly from about 60° C. to a target level of about 130°–190° C. However, when the feed water in the high-pressure feed water heaters is heated suddenly, the distribution of temperatures in the interior thereof becomes unbalanced due to the high variation rate of temperature. Consequently, a high thermal stress occurs in the heaters. This poses a problem of strength of the heaters.

An object of the present invention is to provide a method and an apparatus for warming high-pressure feed water heaters for power plants, which permits preventing the occurrence of an excessively high thermal stress in high-pressure feed water heaters when a power plant is started.

The present invention is directed to a method and an apparatus for warming high-pressure feed water heaters for power plants provided with a boiler having a circulation system, in which a part of high-temperature circulating feed water flowing in a circulation system is taken out therefrom to be introduced into a high-pressure feed water heater from the upstream side thereof and passed therethrough, whereby the feed water heater can be warmed during a period of time between an instant, at which the boiler is ignited, and an instant, at which the high-pressure feed water heater is put in practical use, and in which the occurrence of an excessively high thermal stress in the high-pressure feed water heater can be prevented.

DETAILED DESCRIPTION

Figure 1:
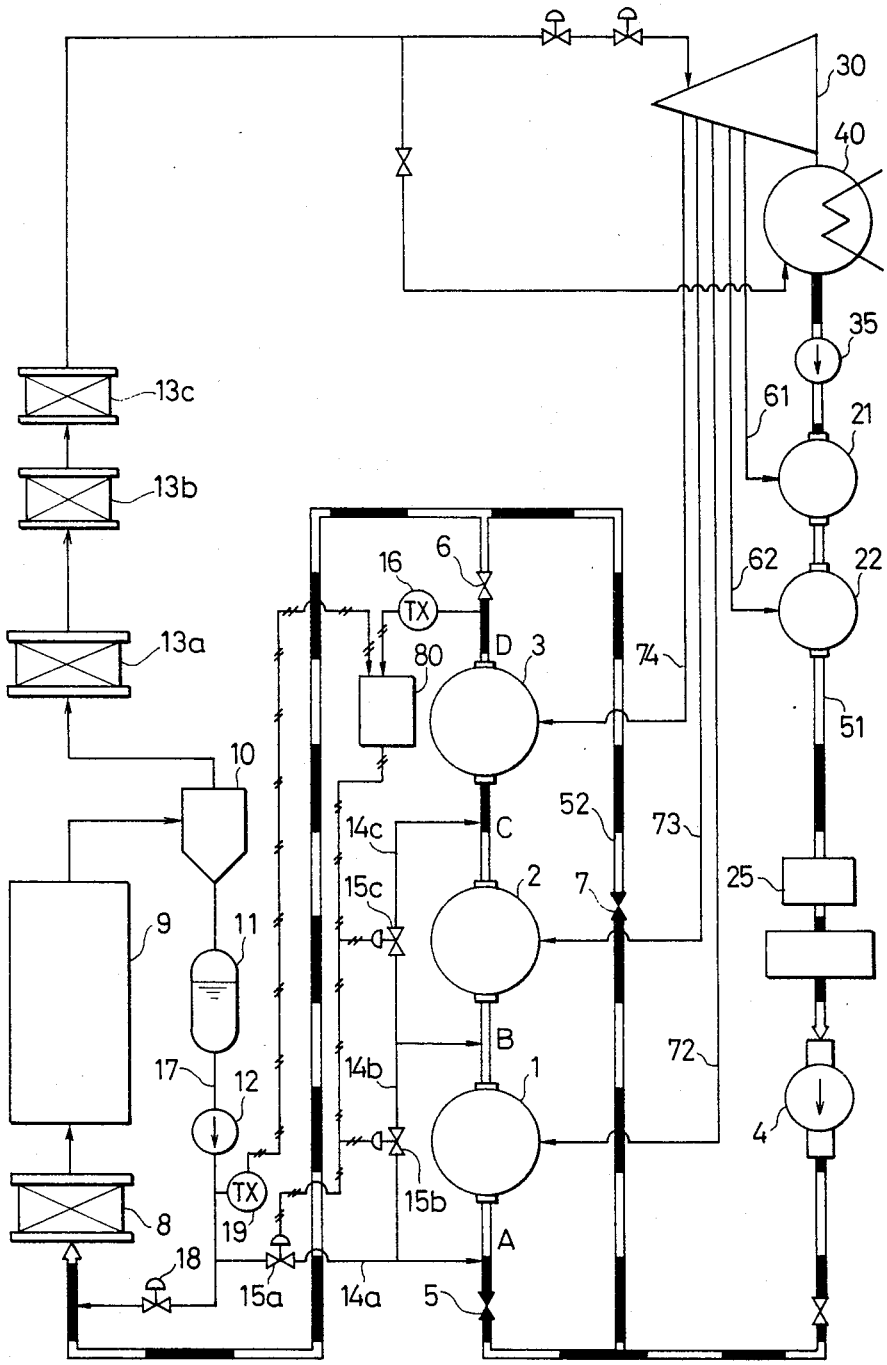
FIG. 1 is a system diagram of a thermal power plant provided with a warming system for high-pressure feed water heaters embodying the present invention.

Referring now to the drawings, and, more particularly, to FIG. 1, the vapor practically used in a steam turbine 30 during a regular operation of the power plant is made more dense in a condenser 40 to turn into condensate, which is supplied to a deaerator 25 through a feed water system 51 by a condensing pump 35. The feed water system 51 is provided thereon with low-pressure feed water heaters 21, 22, with which the condensate is heated to be introduced into the deaerator 25. The condensate from the deaerator 25 is further compressed by a feed water pump 4 to be sent to high-pressure feed water heaters 1, 2, 3 provided on the portion of the feed water system 50 which extends between the deaerator 25 and a fuel economizer 8 in the boiler. The condensate, the temperature of which has been increased by the high-pressure feed water heaters 1, 2, 3, is supplied as feed water to the boiler to the fuel economizer 8 in the boiler, a water wall 9, an air-water separator 10, a primary heater 13*a*, a secondary heater 13*b*, and a third heater 13*c* in the mentioned order. The condensate turns into heated vapor in the third heater 13*c*, which is introduced into a steam turbine 30. Pipes 61, 62, for extracting heated vapor from the steam turbine 30, are provided for the low-pressure feed water heaters 21, 22 positioned on the feed water system 50. Also, steam extraction pipes 72, 73, 74 extending from the steam turbine 30 are connected to the high-pressure feed water heaters 1, 2, 3.

The three high-pressure feed water heaters 1, 2, 3 are connected in series in the mentioned order in the direction, in which the feed water flows. An inlet portion A of the upstream side high-pressure feed water heater 1 is connected to an outlet portion of a boiler feed water pump 4 via an inlet valve 5 in the high-pressure feed water heater. An outlet portion D, which is on the side of the boiler, of the downstream side high-pressure feed water heater 3 is connected to an inlet portion of a fuel economizer 8 in the boiler via an outlet valve 6 in the high-pressure feed water heater. A pipe 52 by-passing the high-pressure feed water heaters 1, 2, 3 is provided in a feed water system 51, and a by-pass valve 7 on the by-pass pipe 52. The boiler in use consists of a Benson boiler, in which the feed water is supplied to the fuel economizer 8, water wall 9, air-water separator 10, first heater 13*a*, second heater 13*b*, and third heater 13*c* in the mentioned order to generate superheated vapor. The feed water, from which vapor has been separated in the air-water separator 10, is by-passed therefrom to flow into a liberating tank 11, a boiler circulating pump 12, and a flow rate regulating valve 18 in order through a circulation system 17, and then to the downstream side of the fuel economizer. Thus, a part of the feed water is circulated in the boiler through the circulation system until a boiler-starting operation has been completed. A warming pipe 14*a* branches from the downstream side of the circulating pump 12 on the circulation system 17, to be communicated with the portion of the feed water system 51 which is on the side of the inlet portion A of No. 1 high-pressure feed water heater 1, which is, among the heaters 1, 2, 3, in the uppermost position with respect to the direction of the flow of the feed water. A branch warming pipe 14*b* extends from the warming pipe 14*a* so as to be communicated at an end portion thereof with the portion of the feed water system 51 which is on the side of an inlet portion B of No. 2 high-pressure feed water heater 2. Also, a warming pipe 14*c* branches from the branch pipe 14*b* so as to be communicated at an end portion thereof with the portion of the feed water system 51 which is on the side of an inlet portion C of No. 3 high-pressure feed water heater 3, which is, among the heaters 1, 2, 3, in the lowermost position with respect to the direction of the flow of the feed water.

These warming pipes 14*a*, 14*b*, 14*c* are provided with temperature regulating valves 15*a*, 15*b*, 15*c*, respectively. In addition, a temperature detector 16, for determining the temperature of the feed water, is provided in the portion of the feed water system 51 which corresponds to the boiler-side outlet D of the lowermost high-pressure feed water heater 3. A warming controller 80 is adapted to generate an operating signal in accordance with a temperature of the feed water, which is obtained by the temperature detector 16, to open or close the temperature regulating valves 15*a*, 15*b*, 15*c*. A temperature detector 19 is provided in the portion of the circulation system 17 which is on the downstream side of the circulating pump 12. The warming controller 80 is operated in accordance with a signal representative of about 130° C. outputted from the detector 19 adapted to determine a temperature rise in the feed water circulated in the boiler circulation system 17 when the boiler is started. The warming controller 80 then outputs an opening signal to the temperature regulating valve 15*a* provided on the warming pipe 14*a*. When the valve 15*a* is opened, a part of the high-temperature feed water flowing in the circulation system 17 enters the inlet portion A of the high-pressure feed water heater 1 through the warming pipe 14*a*, and flows downward through the feed water heaters 1, 2, 3 so as to warm them in order. The temperature of the feed water flowing down in the feed water heaters 1, 2, 3 is determined by the temperature detector 16. As this temperature increases, the temperature regulating valves 15*b*, 15*c* on the warming pipes 14*b*, 14*c* are opened in order by the controller 80. Thus, the high-temperature feed water is also introduced from the inlet portions of the high-pressure feed water heaters 2, 3 to facilitate the warming of the feed water heater. When the temperature of feed water in the high-pressure feed water heaters 1, 2, 3 has finally reached a desired level of about 160° C., and when such a temperature is detected by the temperature detector 16, the temperature regulating valves 15*a*, 15*b*, 15*c* are closed by an operation of the controller 80 to stop supplying the heater-warming high-temperature feed water into the heaters. Thus, an operation for warming the high-pressure feed water heaters 1, 2, 3 is completed. An operation for supplying vapor from the boiler to the steam turbine 30 is then started to introduce the extracted vapor for use in heating the feed water from the steam turbine 30 into the high-pressure feed water heaters 1, 2, 3 through extraction pipes 72, 73, 74, respectively, at the same time, the inlet valve 5 in the high-pressure feed water heater on the feed water system 51 is opened to supply the condensate from a condenser 40 into the high-pressure feed water heaters 1, 2, 3 via a deaerator 25, and thereby start a regular load operation of the steam turbine. During an operation for warming the high-pressure feed water heaters 1, 2, 3 with the controller 80 used, the temperature regulating valves 15*a*, 15*b*, 15*c* may be opened simultaneously to supply the heated feed water from the circulation system 17 into the inlet portions A, B, C of the high-pressure feed water heaters 1, 2, 3 at once through the warming pipes 14*a*, 14*b*, 14*c*, respectively.

A method of warming high-pressure feed water heaters practiced by using the above-described warming apparatus will now be explained.

Figure 2:
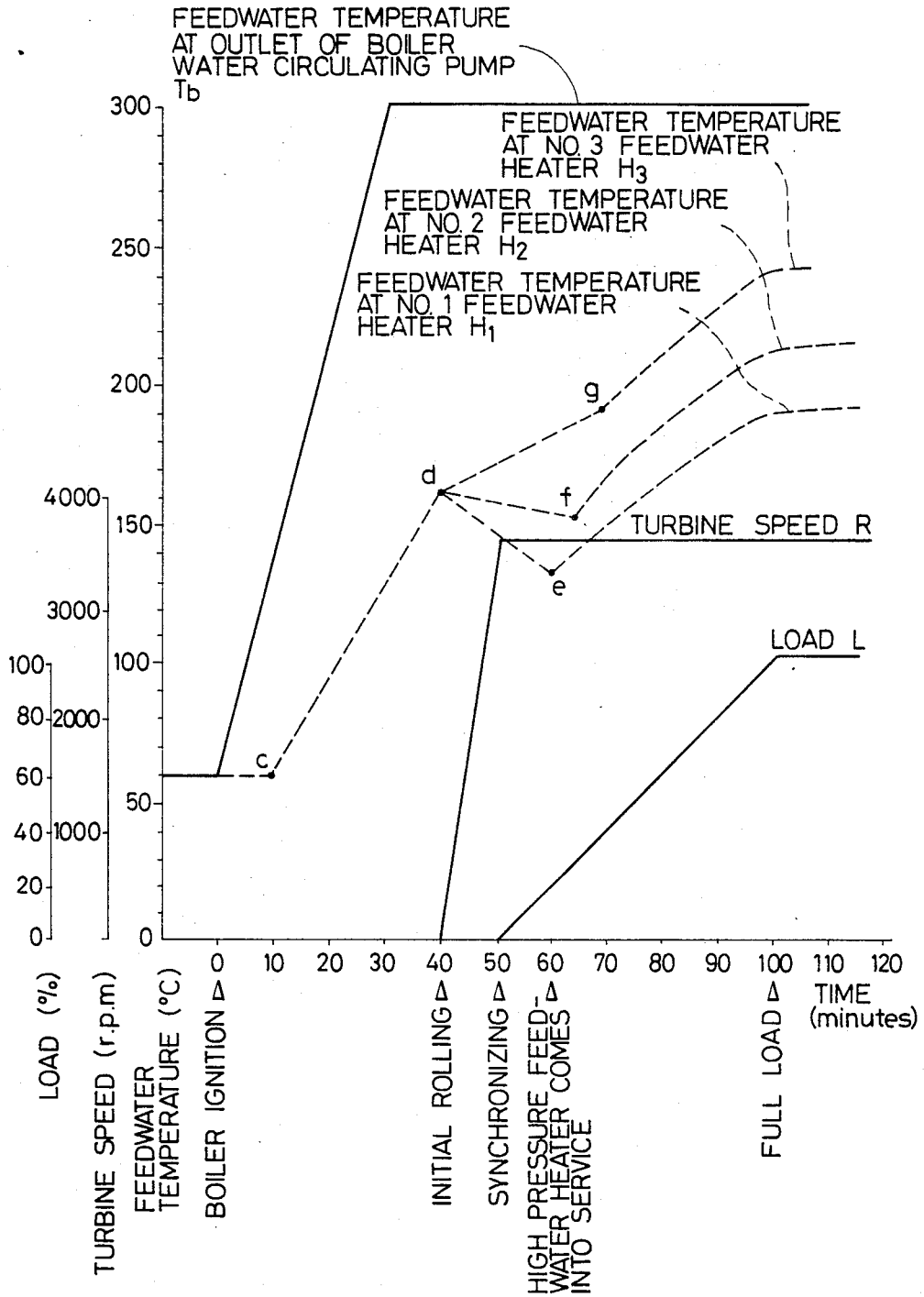
FIG. 2 is a graph showing variations in the temperature of feed water, number of revolutions per minute of a turbine, and a turbine load during a starting step for the power plant shown in FIG. 1.

First, referring to FIGS. 1 and 2, the boiler is ignited with the inlet valve 5 in the high-pressure feed water heater completely closed. At this time, the temperature regulating valves 15*a*, 15*b*, 15*c* are also closed. As shown in FIG. 1, when the boiler is ignited, the feed water therein flows through the fuel economizer 8, water wall 9 and air-water separator 10 in order, and the vapor separated in the air-water separator 10 is introduced into the primary heater 13*a*, secondary heater 13*b* and third heater 13*c* in order, in which the vapor is further heated. The feed water, from which the vapor has been separated in the air-water separator 10, flows down in the circulation system 17 to return to the inlet of the fuel economizer 8 via the liberating tank 11, circulating pump 12 and flow rate regulating valve 18 in order, which are provided on the circulation system 17. Thus, a part of the feed water constantly flows through the circulation system 17. Therefore, a temperature Tb of the feed water, which begins to flow in the circulation system 17 immediately after the boiler is ignited, increases suddenly as shown in FIG. 2, to reach about 300° C. at last, i.e. thirty minutes after the boiler-starting time, or before the vapor is supplied to the turbine. The temperature of the feed water discharged from the boiler circulating pump 12 is detected by the temperature detector 19 provided in the circulation system 17, and the temperature is transmitted to the controller 80. When the temperature of the feed water flowing through the circulation system 17 increases to about 120°–130° C. ten minutes after the boiler is ignited, a signal representative of this temperature is inputted into the controller 80, so that the temperature regulating valve 15*a* provided on the warming pipe 14*a* is thereby opened. As a result, a part of the feed water, the temperature of which has increased to about 120°–130° C., branches from the circulation system 17 to flow into the inlet portion A of the first high-pressure feed water heater 1 through the warming pipe 14*a*. The feed water then flows down in the first second and third high-pressure feed water heaters 1, 2, 3 in order, to start warming these feed water heaters, the feed water in which has a temperature of about 60° C. corresponding to a point C in FIG. 2. The feed water flowing through the high-temperature feed water heater returns to the fuel economizer 8 via the outlet valve 6 therein. The temperature of the feed water flowing through these high-pressure feed water heaters 1, 2, 3 is detected by the temperature detector 16 provided on the portion of the feed water system 51 which corresponds to the boiler-side outlet D of the third high-pressure feed water heater 3, and the temperature regulating valves 15*b*, 15*c* are opened in order by the controller 80 to introduce the high-temperature circulating feed water, which flows through the circulation system 17, into the inlet portions B, C of the second and third high-pressure heaters 2, 3 through the warming pipes 14*b*, 14*c*, respectively. Thus, the warming of these high-pressure feed water heaters can be facilitated.

The warming operation is carried out in such a manner that the temperature of the feed water in the high-pressure feed water heaters 1, 2, 3 reaches finally about 160° C., which corresponds to a point d in FIG. 2, by the time the vapor starts being supplied to the turbine (about forty minutes after the igniting of the boiler). When the temperature of the feed water flowing through the high-pressure feed water heaters 1, 2, 3 reaches 160° C. with this temperature detected by the temperature detector 16, an operating signal is outputted from the controller 80 to close the temperature regulating valves 15*a*, 15*b*, 15*c* provided on the warming pipes 14*a*, 14*b*, 14*c*, and the supplying of high-temperature feed water from the circulation system 17 to the high-pressure feed water heaters 1, 2, 3 is thereby interrupted to complete the warming of the high-pressure feed water heaters. The driving vapor is then supplied to the steam turbine 30 to rotate the same at a rated number of revolutions per minute of 3600. When ten minutes have elapsed after the vapor starts being supplied to the turbine (when fifty minutes have elapsed after the boiler is ignited), a load is put on the turbine. When the vapor starts being supplied to the turbine, it becomes necessary to feed water to the boiler. Accordingly, a by-pass valve 7 in the high-pressure feed water heater is opened to supply feed water to the fuel economizer 8 via a by-pass pipe 52 by an operation of the feedwater pump 4, so that the feed water can be supplied to the boiler at a required rate during a period of time between an instant, at which the vapor starts being supplied to the turbine, and an instant, at which the high-pressure feed water heaters are put in service. When the turbine has come to have an about 20% partial load, it is necessary that the first through third high-pressure feed water heaters 1, 2, 3 be put in service in order. Therefore, the vapor extracted from the steam turbine 30 is introduced into the high-pressure feed water heaters 1, 2, 3 through vapor extraction pipes 72, 73, 74 during a period of time of about twenty–twenty-five minutes between an instant, which is immediately after the starting of supplying vapor to the turbine (an instant, which is forty minutes after the igniting of the boiler), and an instant, at which the high-pressure feed water heaters are put in service (an instant, which is sixty–sixty-five minutes after the igniting of the boiler). Thus, the temperature of 160° C. of the heaters 1, 2, 3, which corresponds to the point d in FIG. 2, and which the feed water therein attains immediately after the completion of a heater-warming operation, is controlled to 130° C., which corresponds to a point e, in the first high-pressure feed water heater 1 in about twenty minutes, 148° C., which corresponds to a point f, in second high-pressure feed water heater 2 in about twenty-three minutes, and 187° C., which corresponds to a point g, in the third high-pressure feed water heater in about twenty-six minutes. After the high-pressure feed water heaters 1, 2, 3 have been put in service, the temperatures of the feed water therein are further increased to $H_1$, $H_2$, $H_3$ as the load is increased.

The controller 80 may be designed in a selected manner to be used for warming the high-pressure feed water heaters. It may be adapted to open the temperature regulating valves 15*a*, 15*b*, 15*c* in order as mentioned above, or open these regulating valves 15*a*–15*c* at once for introducing the high-temperature circulating water in the boiler into the high-pressure feed water heaters 1, 2, 3 simultaneously.

As described above, during an operation for warming the high-pressure feed water heaters 1, 2, 3, the temperature of the feed water in the first heater 1 is varied from d (160° C.) to e (130° C.) for a period of time of about twenty minutes, which is between an instant, at which the vapor starts being supplied to the turbine, and an instant, at which the heaters 1, 2, 3 are put in service. Accordingly, the range of variations in temperatures is −30° C., and the variation rate of temperature (°C./Hr) is (−30° C.)×60 min/20 min=−90° C./Hr.

In the second heater 2, the temperature of the feed water therein is varied from d (160° C.) to f (148° C.) for about twenty-three minutes. Accordingly, the range of variations in temperatures is −12° C., and the variation rate of temperature is (−12° C.)×60 min/23 min =−31° C./Hr.

In the third heater 3, the temperature of the feed water therein is varied from d (160° C.) to g (187° C.) for about twenty-six minutes. Accordingly, the range of variations in temperature is +27° C., and the variation rate of temperature is (+27° C.)×60 min/20 min=+62° C./Hr.

Therefore, during an operation for warming the high-pressure feed water heaters in the above-described embodiment of the present invention, a variation rate of temperature of each of the heaters can be reduced to a remarkable extent, so that an excessively high thermal stress does not occur in these heaters. The variation rates of temperature of the feed water in the high-pressure feed water heaters in a conventional warming apparatus of this kind will be shown for reference. In the first heater, the temperature of the feed water therein increases from 60° C. to 130° C. for twenty minutes after the time of starting supplying vapor from the boiler to the turbine. Accordingly, the variation rate of temperature is 210° C./Hr. In the second heater, the temperature of the feed water therein increases from 60° C. to 148° C. for twenty-three minutes. Accordingly, the variation rate of temperature is 230° C./Hr. In the third heater, the temperature of the feed water increases from 60° C. to 187° C. for twenty-six minutes. Accordingly, the variation rate of temperature is 293° C./Hr. The variation rates of temperature in all of these heaters 1, 2, 3 are very high.

In an operation for warming high-pressure feed water heaters in the embodiment of the present invention, the high pressure feed water in the circulation system is utilized as a heating source. Accordingly, it is possible to start warming the high-pressure feed water heaters as early as about ten minutes after the igniting of the boiler, without waiting until the vapor starts being supplied from the boiler to the turbine forty minutes after the boiler is ignited. Consequently, the variation rate of temperature of the feed water with respect to the time required for increasing the temperature thereof can be reduced to a remarkable extent.

Figure 3:
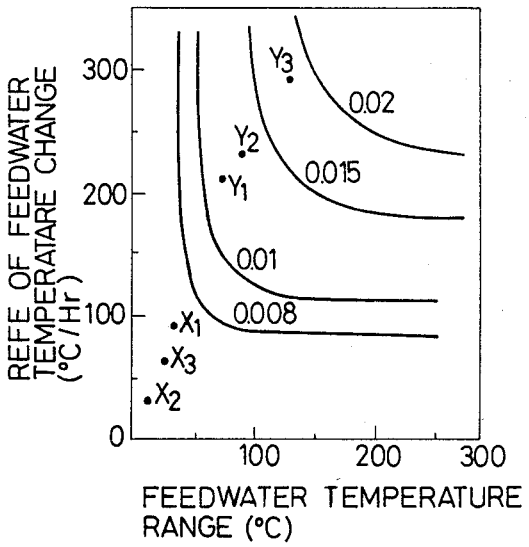
FIG. 3 is a graph showing a life consumption rate of the high-pressure feed water heater for the power plant shown in FIG. 1, per operational cycle of the power plant.

FIG. 3 is a graph showing the life consumption rate of a water chamber in a high-pressure feed water heater provided in a power plant of 600MW class, per one operational cycle of the power plant. The axis of ordinates represents the variation rate of the temperature of the feed water, and the axis of abscissas the range (°C.) of variations in the temperature of the feed water. Each of the four hyperbolic curves represents a life consumption rate in percentage of a water chamber in a high-pressure feed water heater, per one operational cycle of the power plant.

Referring to FIG. 3, the life consumption rates of water chambers in the high-pressure feed water heaters per one operational cycle of a power plant, to which a method of warming the heaters embodying the present invention is applied, will be discussed. The life consumption rate of water chamber in the first heater 1 is in a point $X_1$ due to the relation between the range of variations in temperature of the feed water therein of 30° C. and the variation rate of the temperature of the feed water of 90° C./Hr. The life consumption rate of water chamber in the second heater 2 is in a point $X_2$ due to the relation between the range of variations in temperature of the feed water therein of 12° C. and the variation rate of the temperature of the feed water of 31° C./Hr. The life consumption rate of water chamber in the third heater 3 is in a point $X_3$ due to the relation between the range of variations in temperature of the feed water therein of 27° C. and the variation rate of the temperature of the feed water of 62° C./Hr. As is clear from the above, the life consumption rates of these water chambers can be minimized. In FIG. 3, the life consumption rate of water chambers in conventional first to third high-pressure feed water heaters are also shown for reference in points $Y_1$–$Y_3$, respectively. As may be understood from a comparison between the life consumption rates $X_1$–$X_3$ and $Y_1$–$Y_3$, a warming method embodying the present invention permits reducing the life consumption rates of water chambers in the high-pressure feed water heaters far greater than a conventional method of this kind.

In short, the present invention permits providing a method of and apparatus for warming high-pressure feed water heaters for power plants, which are capable of preventing the occurrence of an excessively high thermal stress in these heaters, and which are substantially free from the problems of strength and life thereof.

I claim:

1. A method of warming high-pressure feed water heaters for power plants provided with a boiler having a boiler circulation system adapted to return hot water separated by a gas water separator provided in an outlet of a boiler water wall to an inlet side thereof, the method comprising the steps of introducing part of the high temperature water which has circulated in the boiler circulation system into a feedwater system on an inlet side of the high-pressure feed water heater through a warming pipe branching from the boiler circulation system, during a period of time between an ignition of the boiler and a coming into service of said high pressure feed water heater, returning the circulating feed water which has passed through said high pressure feed water heater to said boiler, and controlling the flow rate of said high temperature water flowing through said warming pipe in accordance with the temperature of the feed water at the outlet side of said high pressure feed water heater.

2. A method of warming high-pressure feed water heaters for power plants provided with a boiler having a circulation system, comprising the steps of separating from the circulation system a part of high temperature feed water flowing therein, to introduce the resulting feed water into a high pressure feed water heater from the portion of a feed water system which is on the side of an inlet portion thereof, with the feed water flowing out from the heater returned to the boiler, during a period of time which is between an instant at which the boiler is ignited and an instant at which the heater is put in service, wherein the high-temperature feed water separated from the circulation system in the boiler is divided so as to be introduced into the portion of the feed water system which is on the side of inlet portions of a plurality of high pressure feed water heaters.

3. A method of warming high-pressure feed water heaters for power plants according to claim 2, wherein a flow rate of the feed water introduced from the boiler to the high-pressure feed water heater is controlled in accordance with the temperature of the feed water flowing down in the same heater.

4. An apparatus for warming a high-pressure feed water heater in a power plant having a boiler including a boiler circulation system adapted to return hot water separated by a gas water separator provided in an outlet of a boiler water wall to the inlet side thereof, a super heater for heating the steam separated by said gas-water separator, a steam turbine adapted to be driven by steam from said super heater, a condenser means for making denser waste steam from said steam turbine, a feed water system for supplying condensate from said condenser means to the inlet side of said boiler water wall, and a high pressure feed water heater provided in said feed water system, the apparatus comprising a warming pipe branching from said boiler circulation system and communicated with said feed water system on the inlet side of said high-pressure feed water heater, a flow rate control valve provided in said warming pipe, a detector means for detecting the temperature of the feed water on the outlet side of said high pressure feed water heater, and a controller means adapted to control said control valve in dependence upon signals received from said temperature detector means.

5. An apparatus for warming high-pressure feed water heaters for power plants having a boiler with a circulation system, a steam turbine driven by the vapor generated in said boiler, a condenser for making more dense the vapor flowing down from said steam turbine, and a high pressure feed water heater provided in a feed water system adapted to supply condensate from said condenser to said boiler, comprising a warming pipe branching from said circulation system for said boiler and communicated with the portion of said feed water system which is on the side of an inlet portion of said high pressure feed water heater, and a flow rate regulating valve provided on said warming pipe, said warming pipe is further branched to be communicated with that portion of said feed water system which is on the side of inlet portions of a plurality of high pressure feed water heaters, each of said branched warming pipes being provided thereon with said flow rate regulating valve.

6. An apparatus for warming high-pressure feed water heaters for power plants according to claim 5, wherein said apparatus further includes a first temperature detector adapted to detect the temperature of the feed water and provided in the portion of said feed water system which is on the downstream side of said high-pressure feed water heaters, and a controller adapted to control said flow rate regulating valves in accordance with a signal representative of the temperature of the feed water and outputted from said first detector.

7. An apparatus for warming high-pressure feed water heaters for power plants according to claim 6, wherein said apparatus further includes a second temperature detector provided in said feed water system for said boiler and adapted to detect the temperature of the feed water circulated in said boiler, a warming starting signal being outputted from said controller in accordance with a temperature signal outputted from said second temperature detector.

8. A method of warming a high pressure feed water heater for a power plant provided with a boiler having a circulation system, comprising the steps of separating from the circulation system a part of high temperature feed water flowing therein, to introduce resulting feed water into a high pressure feed water heater from the portion of a feed water system which is on the side of an inlet portion thereof, with the feed water flowing out from the heater returned to the boiler, during a period of time which is between an instant at which the boiler is ignited and an instant at which the heater is put into service, wherein a flow rate of the feed water introduced from the boiler to the high pressure feed water heater is controlled in accordance with the temperature of the feed water flowing down in the same heater.

9. An apparatus for warming a high pressure feed water heater for a power plant having a boiler with a circulation system, a steam turbine driven by vapor generated in said boiler, a condenser for making more dense the vapor flowing down from said steam turbine, and a high pressure feed water heater provided in a feed water system adapted to supply condensate from said condenser to said boiler, comprising a warming pipe branching from said circulation system for said boiler and communicated with the portion of said feed water system which is on the side of an inlet portion of said high pressure feed water heater, a flow rate regulating valve provided on said warming pipe, a first temperature detector adapted to detect the temperature of the feed water and provided in a portion of said feed water system which is on a downstream side of said high pressure feed water heater, and a controller adapted to control said flow rate regulating valve in accordance with a signal representative of the temperature of the feed water and supplied from said first temperature detector.

10. An apparatus for warming a high pressure feed water heater for a power plant according to claim 9, further including a second temperature detector provided in said feed water system for said boiler and being adapted to detect the temperature of the feed water circulated in said boiler, a warming starting signal being supplied from said controller in accordance with a temperature signal supplied from said second temperature detector.

11. An apparatus for warming high pressure feed water heaters for power plants having a boiler with a circulation system, a steam turbine driven by the vapor generated in said boiler, a condenser for making more dense the vapor flowing down from said steam turbine, and a high pressure feed water heater provided in a feed water system adapted to supply condensate from said condenser to said boiler, comprising a warming pipe branching from said circulation system for said boiler and communicated with the portion of said feed water system which is on the side of an inlet portion of said high pressure feed water heater, wherein said warming pipe is further branched to be communicated with that portion of said feed water system which is on the side of inlet portions of a plurality of high pressure feed water heaters, each of said branched warming pipes being provided with a flow rate regulating valve, and wherein said warming pipe branches from the portion of said circulation system for said boiler which is on the side of an outlet portion of a circulating pump for said boiler.

* * * * *